US007387158B2

(12) United States Patent
Murray et al.

(10) Patent No.: US 7,387,158 B2
(45) Date of Patent: Jun. 17, 2008

(54) SELF ENERGIZED PACKER

(75) Inventors: Douglas J. Murray, Humble, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/334,095

(22) Filed: Jan. 18, 2006

(65) Prior Publication Data

US 2007/0163777 A1 Jul. 19, 2007

(51) Int. Cl.
*E21B 33/12* (2006.01)

(52) U.S. Cl. ..... 166/196; 166/179; 166/387

(58) Field of Classification Search ..... 166/196, 166/387, 179
See application file for complete search history.

(56) References Cited

U.S. PATENT DOCUMENTS

| | | | | |
|---|---|---|---|---|
| 3,420,363 | A | 1/1969 | Blickensderfer | |
| 3,918,523 | A | 11/1975 | Stuber | |
| 4,137,970 | A | 2/1979 | Laflin et al. | |
| 4,515,213 | A * | 5/1985 | Rogen et al. | 166/123 |
| 4,612,985 | A | 9/1986 | Rubbo et al. | |
| 4,791,992 | A * | 12/1988 | Greenlee et al. | 166/387 |
| 4,862,967 | A | 9/1989 | Harris | |
| 4,919,989 | A | 4/1990 | Colangelo | |
| 4,936,386 | A | 6/1990 | Colangelo | |
| 4,990,545 | A | 2/1991 | Hourai et al. | |
| 5,048,605 | A | 9/1991 | Toon et al. | |
| 5,049,591 | A | 9/1991 | Hayashi et al. | |
| 5,145,935 | A | 9/1992 | Hayashi | |
| 5,195,583 | A | 3/1993 | Toon et al. | |
| 6,073,692 | A | 6/2000 | Wood et al. | |
| 6,581,682 | B1 | 6/2003 | Parent et al. | |
| 6,583,194 | B2 | 6/2003 | Sendijarevic | |
| 6,817,441 | B2 | 11/2004 | Murakami et al. | |
| 6,834,725 | B2 | 12/2004 | Whanger et al. | |
| 6,848,505 | B2 | 2/2005 | Richard et al. | |

(Continued)

FOREIGN PATENT DOCUMENTS

GB 2396635 A 6/2004

(Continued)

OTHER PUBLICATIONS

Baker Hughes Incorporated, Baker Oil Tools, Dual FLX Pack-Off Tubing Hanger; Jan. 31, 2005; 5 pages.

*Primary Examiner*—Giovanna C Wright
(74) *Attorney, Agent, or Firm*—Steve Rosenblatt

(57) ABSTRACT

A packer or plug features a main sealing element that swells after a delay long enough to get it into proper position. A sleeve eventually goes away to let the well fluids at the main sealing element to start the swelling process until contact with the surrounding tubular or the wellbore is established. Other sleeves that are disposed above and below the main sealing element preferably swell, but mainly in a longitudinal direction against the main sealing element to increase its contact pressure against the surrounding tubular or the wellbore. The longitudinally swelling members may also be covered to initiate their growth after the main sealing element has started or even completed its swelling action. The longitudinally swelling members can be constrained against radial growth to direct most or all of their swelling action longitudinally. Extrusion barriers above and below the main sealing element can optionally be used.

20 Claims, 2 Drawing Sheets

U.S. PATENT DOCUMENTS

| | | | | |
|---|---|---|---|---|
| 6,854,522 | B2 | 2/2005 | Brezinski et al. | |
| 2004/0020662 | A1 | 2/2004 | Freyer | |
| 2004/0055760 | A1 | 3/2004 | Nguyen | |
| 2004/0118572 | A1 | 6/2004 | Whanger et al. | |
| 2004/0194971 | A1 | 10/2004 | Thomson | |
| 2004/0261990 | A1 | 12/2004 | Bosma et al. | |
| 2005/0067170 | A1 | 3/2005 | Richard | |
| 2005/0077052 | A1* | 4/2005 | Ohmer | 166/384 |
| 2005/0092363 | A1 | 5/2005 | Richard et al. | |
| 2005/0110217 | A1 | 5/2005 | Wood et al. | |
| 2005/0171248 | A1 | 8/2005 | Li et al. | |

FOREIGN PATENT DOCUMENTS

| | | |
|---|---|---|
| GB | 2406593 A | 4/2005 |
| JP | 04-363499 | 12/1992 |
| JP | 09-151686 | 6/1997 |
| JP | 2000-064764 | 2/2000 |
| WO | WO 2004/018836 A1 | 3/2004 |

* cited by examiner

SELF ENERGIZED PACKER

FIELD OF THE INVENTION

The field of his invention is packers and plugs used downhole and more particularly where the packer assembly produces an incremental force to the action that results in placing the element in a sealing position.

BACKGROUND OF THE INVENTION

Packers and plugs are used downhole to isolate zones and to seal off part of or entire wells. There are many styles of packers on the market. Some are inflatable and others are mechanically set with a setting tool that creates relative movement to compress a sealing element into contact with a surrounding tubular. Generally, the length of such elements is reduced as the diameter is increased. Pressure is continued from the setting tool so as to build in a pressure into the sealing element when it is in contact with the surrounding tubular.

More recently, packers have been used that employ elements that respond to the surrounding well fluids and swell to form a seal. Many different materials have been disclosed as capable of having this feature and some designs have gone further to prevent swelling until the packer is close to the position where it will be set. These designs were still limited to the amount of swelling from the sealing element as far as the developed contact pressure against the surrounding tubular or wellbore. The amount of contact pressure is a factor in the ability to control the level of differential pressure. In some designs there were also issues of extrusion of the sealing element in a longitudinal direction as it swelled radially. A fairly comprehensive summation of the swelling packer art appears below:

I. References Showing a Removable Cover Over a Swelling Sleeve

1) Application US 2004/0055760 A1

FIG. 2*a* shows a wrapping 110 over a swelling material 102. Paragraph 20 reveals the material 110 can be removed mechanically by cutting or chemically by dissolving or by using heat, time or stress or other ways known in the art. Barrier 110 is described in paragraph 21 as an isolation material until activation of the underlying material is desired. Mechanical expansion of the underlying pipe is also contemplated in a variety of techniques described in paragraph 24.

2) Application US 2004/0194971 A1

This reference discusses in paragraph 49 the use of water or alkali soluble polymeric covering so that the actuating agent can contact the elastomeric material lying below for the purpose of delaying swelling. One way to accomplish the delay is to require injection into the well of the material that will remove the covering. The delay in swelling gives time to position the tubular where needed before it is expanded. Multiple bands of swelling material are illustrated with the uppermost and lowermost acting as extrusion barriers.

3) Application US 2004/0118572 A1

In paragraph 37 of this reference it states that the protective layer 145 avoids premature swelling before the downhole destination is reached. The cover does not swell substantially when contacted by the activating agent but it is strong enough to resist tears or damage on delivery to the downhole location. When the downhole location is reached, pipe expansion breaks the covering 145 to expose swelling elastomers 140 to the activating agent. The protective layer can be Mylar or plastic.

4) U.S. Pat. No. 4,862,967

Here the packing element is an elastomer that is wrapped with an imperforate cover. The coating retards swelling until the packing element is actuated at which point the cover is "disrupted" and swelling of the underlying seal can begin in earnest, as reported in Column 7.

5) U.S. Pat. No. 6,854,522

This patent has many embodiments. The one in FIG. 26 is foam that is retained for run in and when the proper depth is reached expansion of the tubular breaks the retainer 272 to allow the foam to swell to its original dimension.

6) Application U.S. 2004/0020662 A1

A permeable outer layer 10 covers the swelling layer 12 and has a higher resistance to swelling than the core swelling layer 12. Specific material choices are given in paragraphs 17 and 19. What happens to the cover 10 during swelling is not made clear but it presumably tears and fragments of it remain in the vicinity of the swelling seal.

7) U.S. Pat. No. 3,918,523

The swelling element is covered in treated burlap to delay swelling until the desired wellbore location is reached. The coating then dissolves of the burlap allowing fluid to go through the burlap to get to the swelling element 24 which expands and bursts the cover 20, as reported in the top of Column 8)

8) U.S. Pat. No. 4,612,985

A seal stack to be inserted in a seal bore of a downhole tool is covered by a sleeve shearably mounted to a mandrel. The sleeve is stopped ahead of the seal bore as the seal first become unconstrained just as they are advanced into the seal bore.

II. References Showing a Swelling Material Under an Impervious Sleeve

1) Application US 2005/0110217

An inflatable packer is filled with material that swells when a swelling agent is introduced to it.

2) U.S. Pat. No. 6,073,692

A packer has a fluted mandrel and is covered by a sealing element. Hardening ingredients are kept apart from each other for run in. Thereafter, the mandrel is expanded to a circular cross section and the ingredients below the outer sleeve mix and harden. Swelling does not necessarily result.

3) U.S. Pat. No. 6,834,725

FIG. 3*b* shows a swelling component 230 under a sealing element 220 so that upon tubular expansion with swage 175 the plugs 210 are knocked off allowing activating fluid to reach the swelling material 230 under the cover of the sealing material 220.

4) U.S. Pat. No. 5,048,605

A water expandable material is wrapped in overlapping Kevlar sheets. Expansion from below partially unravels the Kevlar until it contacts the borehole wall.

5) U.S. Pat. No. 5,195,583

Clay is covered in rubber and a passage leading from the annular space allows well fluid behind the rubber to let the clay swell under the rubber.

6) Japan Application 07-334115

Water is stored adjacent a swelling material and is allowed to intermingle with the swelling material under a sheath 16.

III. References which Show an Exposed Sealing Element that Swells on Insertion

1) U.S. Pat. No. 6,848,505

An exposed rubber sleeve swells when introduced downhole. The tubing or casing can also be expanded with a swage.

2) PCT Application WO 2004/018836 A1

A porous sleeve over a perforated pipe swells when introduced to well fluids. The base pipe is expanded downhole.

3) U.S. Pat. No. 4,137,970

A swelling material 16 around a pipe is introduced into the wellbore and swells to seal the wellbore.

4) US Application US 2004/0261990

Alternating exposed rings that respond to water or well fluids are provided for zone isolation regardless of whether the well is on production or is producing water.

5) Japan Application 03-166,459

A sandwich of slower swelling rings surrounds a faster swelling ring. The slower swelling ring swells in hours while the surrounding faster swelling rings do so in minutes.

6) Japan Application 10-235,996

Sequential swelling from rings below to rings above trapping water in between appears to be what happens from a hard to read literal English translation from Japanese.

7) U.S. Pat. Nos. 4,919,989 and 4,936,386

Bentonite clay rings are dropped downhole and swell to seal the annular space, in these two related patents. 8) US Application US 2005/009363 A1

Base pipe openings are plugged with a material that disintegrates under exposure to well fluids and temperatures and produces a product that removes filter cake from the screen.

9) U.S. Pat. No. 6,854,522

FIG. 10 of this patent has two materials that are allowed to mix because of tubular expansion between sealing elements that contain the combined chemicals until they set up.

10) US Application US 2005/0067170 A1

Shape memory foam is configured small for a run in dimension and then run in and allowed to assume its former shape using a temperature stimulus.

IV. Reference that Shows Power Assist Actuated Downhole to Set a Seal

1) U.S. Pat. No. 6,854,522

This patent employs downhole tubular expansion to release potential energy that sets a sleeve or inflates a bladder. It also combines setting a seal in part with tubular expansion and in part by rotation or by bringing slidably mounted elements toward each other. FIGS. 3, 4, 17-19, 21-25, 27 and 36-37 are illustrative of these general concepts.

The various concepts in U.S. Pat. No. 6,854,522 depend on tubular expansion to release a stored force which then sets a material to swelling. As noted in the FIG. 10 embodiment there are end seals that are driven into sealing mode by tubular expansion and keep the swelling material between them as a seal is formed triggered by the initial expansion of the tubular. What is not shown in this or the other listed references is a device that enhances the seal of a swelling seal member with another member that acts on it as the seal expands. Various embodiments of the present invention will illustrate to one skilled in the art how the present invention provides a boost sealing force to a swelling or expanding sealing member to improve the contact pressure and hence the ability to seal against greater differential pressures. These and other aspects of the present invention will become more apparent to those skilled in the art from a review of the description of the preferred embodiment and the associated drawings as well as the claims which define the full scope of the invention.

SUMMARY OF THE INVENTION

A packer or plug features a main sealing element that swells after a delay long enough to get it into proper position. A sleeve eventually goes away to let the well fluids at the main sealing element to start the swelling process until contact with the surrounding tubular or the wellbore is established. Other sleeves that are disposed above and below the main sealing element preferably swell but mainly in a longitudinal direction against the main sealing element, to increase its contact pressure against the surrounding tubular or the wellbore. The longitudinally swelling members may also be covered to initiate their growth after the main sealing element has started or even completed its swelling action. The longitudinally swelling members can be constrained against radial growth to direct most or all of their swelling action longitudinally. Extrusion barriers above and below the main sealing element can optionally be used.

DETAILED DESCRIPTION OF THE PREFERRED EMBODIMENT

Figure 1:
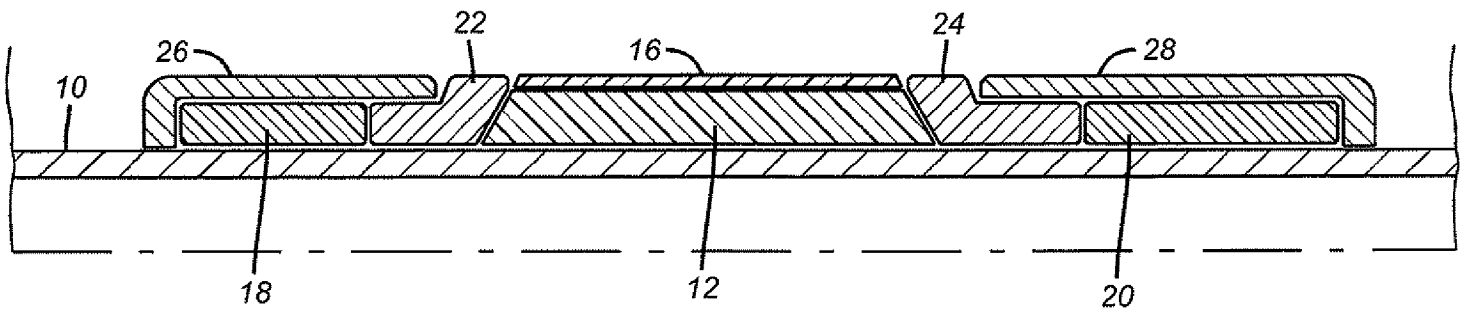
FIG. 1 is a section view in the run in position of a packer of the present invention.

FIG. 1 shows a mandrel 10 that has a main sealing element 12 mounted to it. The element 12 preferably swells under exposure to well fluids whereupon it grows in radial dimension until it attains contact with the surrounding tubular or the wellbore, neither of which are shown for greater clarity in the drawing. The swelling material can be one of many materials known to swell under exposure to the fluids that are expected to be found at or near the intended setting depth of the packer or plug. A protective sleeve 16 surrounds the main sealing element 12 to not only protect it on the way into the wellbore but also to delay the onset of swelling until the zone of placement is attained. Sleeve 16 can be of a metallic construction or a non-metallic material. Either way the well fluids after a certain duration of exposure will interact with sleeve 16 with the resulting effect that well fluids will then be able to make intimate contact with main sealing element 12 to start it swelling in a radial direction. Those skilled in the art will recognize that there may also be some longitudinal dimensional change as the element 12 grows in diameter. The selection of the swelling material from a variety of materials known in the art for this purpose, will dictate the speed and the contact pressure with the surrounding wellbore that the element 12 will make, if left to its own devices. The present invention boosts the internal pressure in the sealing element 12 as will be described below.

In the preferred embodiment, backup elements 18 and 20 are disposed on opposite sides of element 12 although optionally only one on one side can be provided. Elements 18 and 20 preferably swell longitudinally more than radially such that they will magnify the internal pressure in element 12 when they grow longer along mandrel 10. Anti-extrusion rings 22 and 24 are positioned adjacent opposed ends of sealing element 12 but can optionally be disposed at one end or omitted altogether. Preferably they are non-swelling when exposed to well fluid and are free to move longitudinally along mandrel 10 in response to swelling of element 12 or elements 18 and 20. Elements 18 and 20 can be covered with covers 26 and 28. These covers can be used to time the onset of longitudinal swelling of elements 18 and 20 to preferably a time where element 12 has already started swelling or even later when element 12 is fully swollen. One reason for the time delay is that the swelling force of element 12 is greater initially than when swelling is nearly or fully complete. For that reason, it is advantageous to delay the longitudinal growth of element 18 and 20 so that when they start to grow longitudinally they meet a lower resisting force from the swelling of element 12. Covers 26 and 28 can serve another purpose. They can be rigid enough to retard any tendency of radial growth by elements 18 and 20 and channel such elongation to the longitudinal direction. They can serve a double duty in retarding the onset of longitudinal growth as well as suppressing any tendency for radial expansion while redirecting such growth into the preferred longitudinal direction along mandrel 10. As one example the covers 26 and 28 can be perforated metallic structures with an impervious coating that goes away after a time of exposure to well fluids. When the covers go away the perforations allow well fluid to start the elements 18 and 20 to grow while the covers 26 and 28 are strong enough to constrain the growth to the preferred longitudinal direction.

Rings 22 and 24 function as anti-extrusion rings, in a known manner. It should also be noted that elements 18 and 20 can be made from shape memory materials to that upon exposure to the required stimulus downhole can revert to their original shape which would involve growth in a longitudinal direction to put additional internal pressure in element 12 automatically as a part of the setting process.

The order of swelling can be accomplished by making cover 16 from a thinner but identical material as covers 26 and 28. Alternatively, the covers can be of differing materials selected to make the element 12 start if not complete swelling before elements 18 and 20 begin to grow longitudinally to increase the internal pressure of the element 12 against the surrounding tubular or the wellbore. Alternatively, Swelling or longitudinal growth of elements 18 and 20 before element 12 is also envisioned.

Other alternatives are envisioned. For example, elements 18 or 20 or both of them can be mounted to mandrel 10 in a position where they store energy but such energy is prevented from being released to apply a force against element 12 until element 12 itself swells and unleashes the stored force or alternatively the well fluids over time defeat the retainer of the stored force and unleash the force to act longitudinally to raise the internal pressure in the main element 12. Some examples of this are a shear pin that gets attacked by well fluids after element 12 has had an opportunity to begin or even conclude radial swelling. Another alternative would be to use the radial growth of the element 12 to simply pop a retaining collar apart so that the stored energy force is released in the longitudinal direction. The stored force can be a spring, a pressurized chamber acting on a piston or a resilient material mounted to the mandrel 10 in a compressed state, to name just a few options.

The various sleeves that cause the time delays can be made from polymers or metals that dissolve in the well fluids. The swelling material options are reviewed in the patents cited above whose contents are incorporated by reference. Some examples are rubber, swelling clays, or polymers known to increase in volume on exposure to hydrocarbons or water or other materials found in the wellbore.

Radial expansion of the mandrel 10 can also be combined with the structures described above to further enhance the sealing and/or to be the trigger mechanism that releases elements 18 and 20 to release the longitudinal force on element 12. For example a stack of Bellville washers can be retained by a ring that is broken by radial expansion to release a longitudinal force against a swelling element 12.

Figure 2:
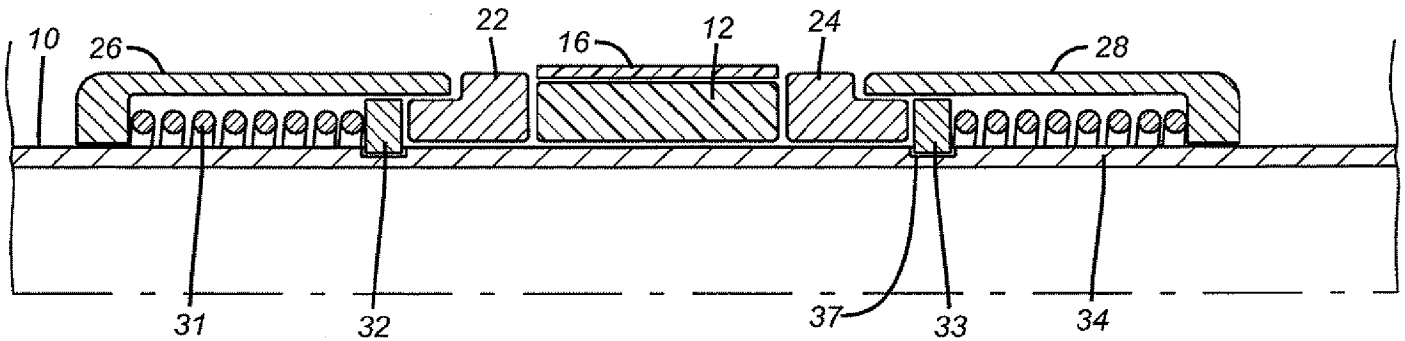
FIG. 2 is an alternative embodiment to FIG. 1 using a spring boost in opposed directions.

FIG. 2 shows an alternative technique where rings 22 and 24 are on opposed sides of the element 12, as previously described. A retainer 33 is initially held in a groove 37 and holds spring 36 in a compressed state. The other side has a mirror image arrangement using a compressed spring 31 held by a retainer 32. Once run in the well and exposed to well fluids and temperatures the retainers 32 and 33 weaken to release the stored force in the respective springs 31 and 36. The result is a set of opposed direction boost forces on the element 12.

Figure 3:
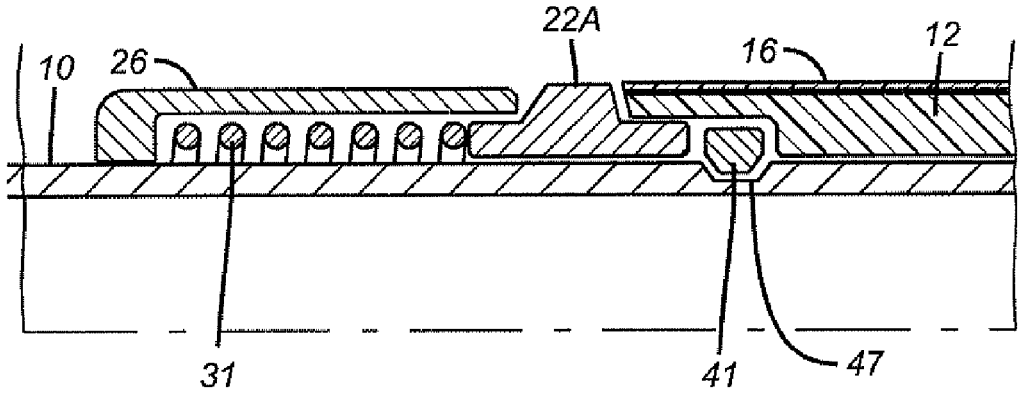
FIG. 3 is another alternative where a spring force is released by element swelling.

FIG. 3 shows spring 31 bearing on anti-extrusion ring 22A which is retained, in turn by a c-ring 41 lodged in a groove 47. As the element 12 swells, it gets softer until such time as the stored force of the spring 31 is strong enough to drive the c-ring 41 out of groove 47 so as to apply a boost force on the element 12.

Figure 4:
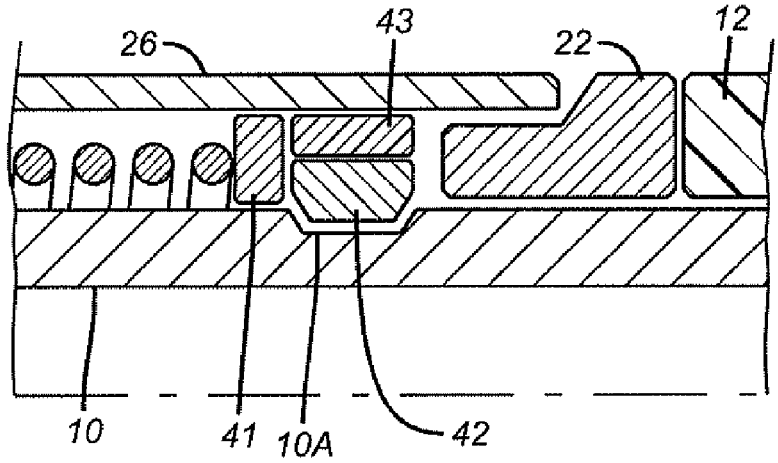
FIG. 4 shows a retainer that releases a spring force for a boost on the sealing element.

FIG. 4 is a variation on the FIG. 3 design. Here a c-ring 42 is retained in groove 10A by a retaining ring 43. Optionally, a spring washer 41 can accept the force from the compressed spring. The retaining ring 43 is preferably made of a bio-polymer such that bottom hole temperatures cause it to weaken or dissolve thus allowing the c-ring 42 to expand to release the spring force against the element 12. Alternatively, even if the retaining ring 43 doesn't dissolve, it will likely creep enough under downhole conditions to release the c-cring 42.

Those skilled in the art will know that various types of springs can be used including Belleville washers or trapped compressible fluids under pressure. Additional, variations on the temporary retainers for the spring device can be employed apart from rings that weaken or split rings that are temporarily retained. The objective is to store a force that can automatically act on the element 12 after a sufficient delay to allow proper positioning in the wellbore.

The above description is illustrative of the preferred embodiment and many modifications may be made by those skilled in the art without departing from the invention whose scope is to be determined from the literal and equivalent scope of the claims below.

We claim:

1. A packer for downhole use, comprising:

a mandrel having an outer surface;

an annularly shaped swelling element in substantial contact with said mandrel along its length for selective sealing downhole due to a volume increase that results from taking on fluids downhole within said annular shape to accomplish said swelling; and at least one boost member on said outer surface of said mandrel selectively applying a force to said swelling element to enhance the sealing downhole.

2. The packer of claim 1, wherein:

said boost member grows along said mandrel to apply said force.

3. The packer of claim 1, wherein:

said boost member swells to apply said force.

4. The packer of claim 1, wherein:

said boost member grows more along said mandrel to apply said force than in a radial direction away from said mandrel.

5. The packer of claim 1, wherein:

a retainer on said boost member is released to apply said boost force.

6. The packer of claim 5, wherein:

said retainer is released by exposure to well fluids.

7. The packer of claim 5, wherein:

said retainer is released by swelling of said swelling element.

8. The packer of claim 1, wherein:

said boost member comprises a shape memory material that grows along said mandrel to apply said boost force.

9. The packer of claim 1, wherein:

said boost member comprises at least one of a compressed resilient material and a piston associated with a pressurized chamber.

10. The packer of claim 1, wherein:

said boost member is separated from said swelling element by at least one retaining ring.

11. The packer of claim 1, wherein:

said boost member begins swelling at least as early as when said swelling element begins to swell.

12. The packer of claim 11, wherein:

said boost member swells to apply said force.

13. A packer for downhole use, comprising:

a mandrel;

a swelling element mounted to said mandrel for selective sealing downhole due to a volume increase that results from said swelling; and at least one boost member selectively applying a force to said swelling element to enhance the sealing downhole;

said boost member is restrained against growth in a radial direction away from said mandrel.

14. A packer for downhole use, comprising:

a mandrel;

a swelling element mounted to said mandrel for selective sealing downhole due to a volume increase that results from said swelling; and at least one boost member selectively applying a force to said swelling element to enhance the sealing downhole;

said boost member is initially isolated from well fluids that cause it to swell on contact.

15. A packer for downhole use, comprising:

a mandrel having an outer surface;

a swelling element mounted to said mandrel for selective sealing downhole due to a volume increase that results from taking on fluids downhole to accomplish said swelling;

at least one boost member on said outer surface of said mandrel selectively applying a force to said swelling element to enhance the sealing downhole;

said swelling element is initially isolated from well fluids that cause it to swell on contact.

16. A packer for downhole use, comprising:

a mandrel;

a swelling element mounted to said mandrel for selective sealing downhole due to a volume increase that results from said swelling; and at least one boost member selectively applying a force to said swelling element to enhance the sealing downhole;

said mandrel is expanded to release said force from said boost member.

17. A packer for downhole use, comprising:

a mandrel having an outer surface;

a swelling element mounted to said mandrel for selective sealing downhole due to a volume increase that results from taking on fluids downhole to accomplish said swelling;

at least one boost member on said outer surface of said mandrel selectively applying a force to said swelling element to enhance the sealing downhole;

said boost member swells at a slower rate than said swelling element.

18. A packer for downhole use, comprising:

a mandrel;

a swelling element mounted to said mandrel for selective sealing downhole; and at least one boost member selectively applying a force to said swelling element to enhance the sealing downhole;

said boost member begins swelling at least as early as when said swelling element begins to swell;

covers of different thickness or material initially cover said swelling element and said boost member only to be rendered porous by fluids in the wellbore.

19. The packer of claim 18, wherein:

said covers are made from one or more of a dissolvable polymer and a metal.

20. A packer for downhole use, comprising:

a mandrel having an outer surface;

a swelling element mounted to said mandrel for selective sealing downhole due to a volume increase that results from taking on fluids downhole to accomplish said swelling;

at least one boost member on said outer surface of said mandrel selectively applying a force to said swelling element to enhance the sealing downhole;

said boost member begins swelling when said swelling element is substantially fully swollen.

* * * * *